United States Patent [19]

Hickmann

[11] 4,237,809

[45] Dec. 9, 1980

[54] COVER FOR A BARGE

[75] Inventor: Horst Hickmann, Cincinnati, Ohio

[73] Assignee: The Ohio River Company, Cincinnati, Ohio

[21] Appl. No.: 16,921

[22] Filed: Mar. 2, 1979

[51] Int. Cl.[3] ..... B63B 19/18

[52] U.S. Cl. ..... 114/202; 9/1.5

[58] Field of Search ..... 9/1.5; 105/377; 114/202, 203, 26

[56] References Cited

U.S. PATENT DOCUMENTS

| | | | |
|---|---|---|---|
| 2,831,448 | 4/1958 | Suderow | 114/202 |
| 3,463,111 | 8/1969 | Bain et al. | 114/202 |
| 3,520,257 | 7/1970 | James | 105/377 |
| 3,540,771 | 11/1970 | Stoneburner | 105/377 X |

FOREIGN PATENT DOCUMENTS

| | | | |
|---|---|---|---|
| 41711 | 5/1959 | Poland | 114/202 |
| 751939 | 7/1956 | United Kingdom | 114/202 |

*Primary Examiner*—Duane A. Reger

*Attorney, Agent, or Firm*—Kinney & Schenk

[57] ABSTRACT

A hopper barge has a cover formed by a plurality of telescoping housings with the central housing being the highest and the other housings decreasing in height to the outermost housing at each end. The central housing has a transverse plate extending across it at the center of its length. The outermost housing at each end is driven separately with the other housings having cooperating elements to engage each other to cause the housings on each side of the transverse plate of the central housing to sequentially move in or out with respect to the central housing. All of the housings have glides or wheels on each side for riding on flat surfaces supported on opposite sides of the barge.

23 Claims, 17 Drawing Figures

COVER FOR A BARGE

Hopper barges carry various types of materials. It is necessary for many of these materials to be protected by a cover during transport by barge.

Various types of covers have previously been utilized with hopper barges. One type of cover has been a steel roller cover formed of several separate housings of steel with each housing supported by rollers riding in a U-shaped track. This steel roller cover has had every other housing higher than the housing on each end thereof. Because the housings are relatively heavy, the removal of the steel roller cover has required a number of personnel, a crane or similar type of structure to move the various housings, and a substantial period of time after the barge is docked. The return of the steel roller cover to its closed position also has the same problems.

Furthermore, the rollers on the housings of the steel roller cover have had the tendency to cease to ride in the tracks on the barge because the barge tends to bow inwardly at the center of its length when loaded with a relatively dense cargo. This is because the barge is not supported by transverse beams other than transverse floor frames.

Additionally, portions of the barge are subjected to substantially different temperatures since the portion of the barge within the water is in a relatively cool ambient while the portion of the barge above the water is in a relatively high temperature ambient when subjected to the sun during the summer. Furthermore, the sides of the barge also are subjected to hydrostatic pressure.

There also has existed the problem of the track for the rollers of the steel roller cover being filled when a cargo is loaded. Thus, even though the rollers, which support the barge, are not removed from the track because of the load of dense cargo, for example, the rollers may not be able to move along the track because of the presence of material therein.

Fiberglass lift covers also have previously been utilized with a hopper barge. This cover has required a relatively large number of personnel to either place the fiberglass covers on the barge or remove them from the barge after the barge is docked and a substantial period of time such as one or two man hours, for example. Thus, while the fiberglass cover is relatively lightweight in comparison with the steel roller cover, the fiberglass cover has required a substantial period of time and a substantial number of personnel.

The present invention overcomes the foregoing problems through providing a cover requiring only one or two persons to move the cover from a closed position to an open position or vice versa. This can be accomplished in a relatively short period of time such as twenty minutes, for example.

Furthermore, the previous disadvantage of having to move the covers after the barge has docked is avoided with the cover of the present invention because the cover of the present invention can be moved from a closed position to an open position as the barge approaches the dock and returned to its closed position after the barge leaves the dock. Thus, no loss of loading and unloading time by dock personnel is incurred when using the cover of the present invention.

By having the personnel of the barge move the cover between its open and closed positions, the possibility of damage to the cover is reduced because the barge personnel become responsible for any damage thereto.

Thus, blame for any damage cannot be placed on the dock personnel, who are not under the control of the barge operator. Therefore, more care in handling the cover is obtainable than with the previously available covers.

The present invention also avoids the difficulty of contamination of the track by the material being loaded. This is accomplished by supporting the housings of the cover of the present invention on glides or wheels, which ride along flat surfaces on opposite sides of the barge. By providing means on the glides or means cooperating with the wheels, any material on the flat surfaces on the opposite sides of the barge is moved outboard so as not to remain in the path of the glides or the wheels. Thus, there is no possibility of the material being collected in an area in which it can prevent or retard movement of the housings of the cover.

The present invention is designed so that a crane operator, for example, cannot easily attach a hook to any of the housings of the cover. This avoids any movement of the cover by dock personnel rather than by the barge personnel.

The present invention also compensates for the inner deflection of the barge at its center with respect to its ends. That is, the cover of the present invention has the central housing, which is the widest housing, supported so that its track engaging surfaces will return to the tracks if the sides of the barge should be moved inwardly sufficiently to cause the track engaging surfaces of the central housing to be moved off of the tracks.

The present invention also provides a relatively lightweight cover of metal in comparison with the previously available steel roller cover. Thus, by the cover being relatively lightweight, it is easier to move.

In the previously available steel roller cover, it has been necessary to lock each of the housings of the cover to the barge. This has been accomplished by pins, which can be easily lost or damaged.

The present invention overcomes this problem through providing an arrangement in which each of the two driving means for moving the housings of the cover between the open and closed positions includes means to lock each of the two housings, which are connected to the two driving means, against inadvertent movement. Because of the telescoping and nesting relation of the housings, the locking of the two housings connected to the two driving means limits any movement of the other housings of the cover of the present invention.

An object of this invention is to provide a cover for a barge.

Another object of this invention is to provide a relatively lightweight cover for a barge.

A further object of this invention is to provide a cover for a barge in which the cover is movable between its open and closed positions by one or two persons.

Still another object of this invention is to provide positive driving of cables connecting a housing to a driving means.

Other objects, uses, and advantages of this invention are apparent upon a reading of this description, which proceeds with reference to the drawings forming part thereof and wherein.

Figure 1:
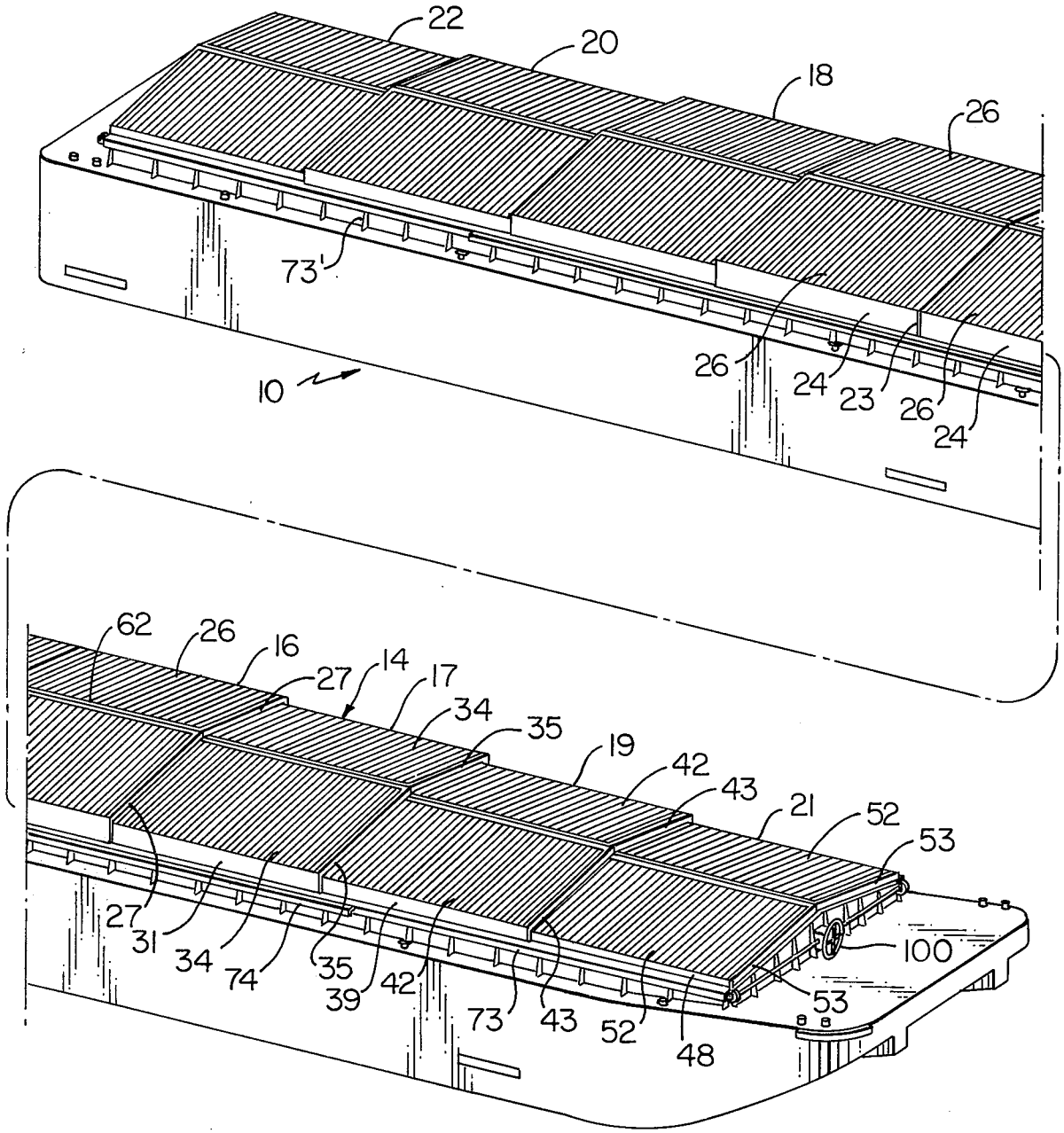
FIG. 1 is a perspective view of a hopper barge having the cover of the present invention with the cover in its closed position.
Figure 2:
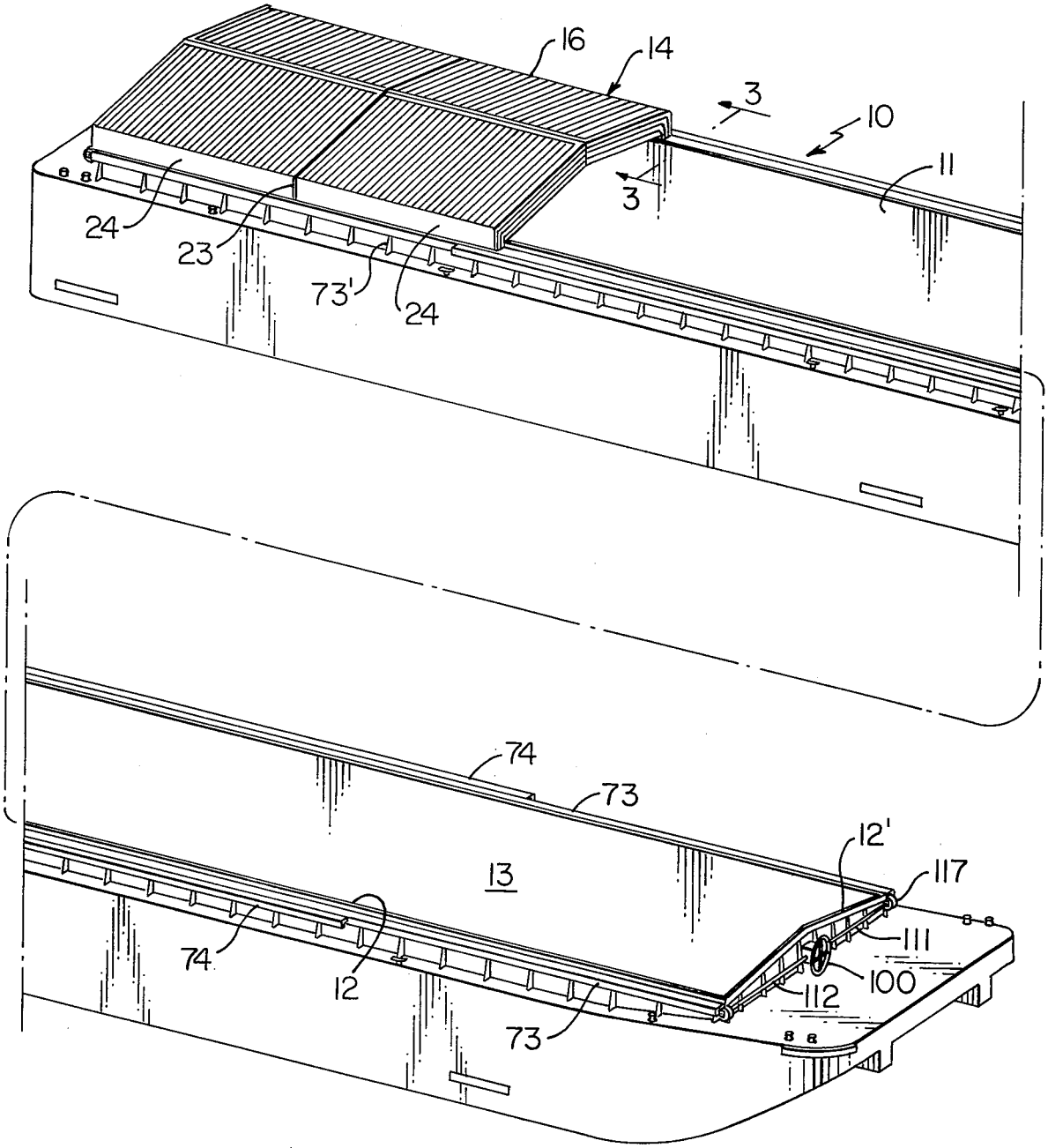
FIG. 2 is a perspective view, similar to FIG. 1, but showing the cover in one of its open positions.

Referring to the drawings and particularly FIGS. 1 and 2, there is shown a hopper barge 10. The barge 10 has substantially parallel side walls 11 and 12 and substantially parallel end walls (one shown at 12') defining a hopper area 13 within which material can be received.

A cover 14 closes the entire hopper area 13 of the barge 10 when in the position of FIG. 1. When the cover 14 is in the position of FIG. 2, the maximum opening of the hopper area 13 of the barge 10 is obtained. It should be understood that the cover 14 could be similarly positioned at the other end of the barge 10 from that shown in FIG. 2 or intermediate the ends of the hopper area 13 of the barge 10, if desired.

The cover 14 includes a central housing 16, a housing 17 at one end of the central housing 16, a housing 18 at the other end of the housing 16, a housing 19 adjacent the housing 17, a housing 20 adjacent the housing 18, a housing 21 adjacent the housing 19, and a housing 22 adjacent the housing 20.

The central housing 16 is the highest and widest of all of the housings 16–22 of the cover 14. The housings 17 and 18, which are adjacent the housing 16 at each end thereof, are the next highest and widest of the housings 16–22 and are telescopically received within the housing 16 when the cover 14 is in its open position of FIG. 2, for example.

The housings 19 and 20 are of less height and width than the housings 17 and 18, respectively, so as to be telescopically received within the housings 17 and 18, respectively. The housings 21 and 22 are slightly less in height and width than the housings 19 and 20, respectively, so as to be telescopically received within the housings 19 and 20, respectively.

The length of the housing 16 is greater than twice the length of any of the other housings 17–22. The lengths of the housings 17 and 18 are the same and slightly greater than the length of each of the housings 19 and 20. The lengths of the housings 19 and 20 are the same and slightly greater than the length of each of the housings 21 and 22. The length of each of the housings 21 and 22 is the same.

The housing 16 includes a transverse plate 23 at the center of its length and extending between the opposite sides of the housing 16. The housing 16 has a pair of aluminum sidings 24 (see FIG. 6) secured to one side of the transverse plate 23 by suitable means such as welding, for example. The other side of the transverse plate 23 has similar sidings 24 (see FIG. 1) connected thereto. Each of the sidings 24 has a plurality of vertically disposed T-shaped aluminum stiffeners 25 (see FIG. 6), which are longitudinally spaced along its inner surface, secured thereto to stiffen the siding 24.

The upper end of the transverse plate 23 of the housing 16 has corrugated roofing sheets 26 (see FIG. 4) of aluminum extending between each of its surfaces and a pair of U-shaped channels 27 (one shown in FIG. 4) of aluminum at each end of the housing 16. An adhesive sealent 28 or suitable mechanical fasteners secure each of the roofing sheets 26 to the transverse plate 23 and an upper leg 29 of one of the channels 27.

The housing 17 includes an end plate 30, which is substantially parallel to the transverse plate 23 and an aluminum siding 31 (see FIG. 6) secured to each side thereof by suitable means such as welding, for example. Each of the sidings 31, which are substantially parallel to the sidings 24, is stiffened by vertically disposed T-shaped aluminum stiffeners 32, which are longitudinally spaced along the inner surface thereof.

The upper end of the end plate 30 has a flange 33 (see FIG. 4) extending for its entire distance in the transverse direction. Corrugated roofing sheets 34 of aluminum extend between the end plate 30 adjacent the flange 33 and each of a pair of U-shaped channels 35 of aluminum at the forward end of the housing 17. An adhesive sealant 35' or suitable mechanical fasteners secure each of the roofing sheets 33 to the end plate 30 and an upper leg 36 of one of the channels 35.

Figure 4:
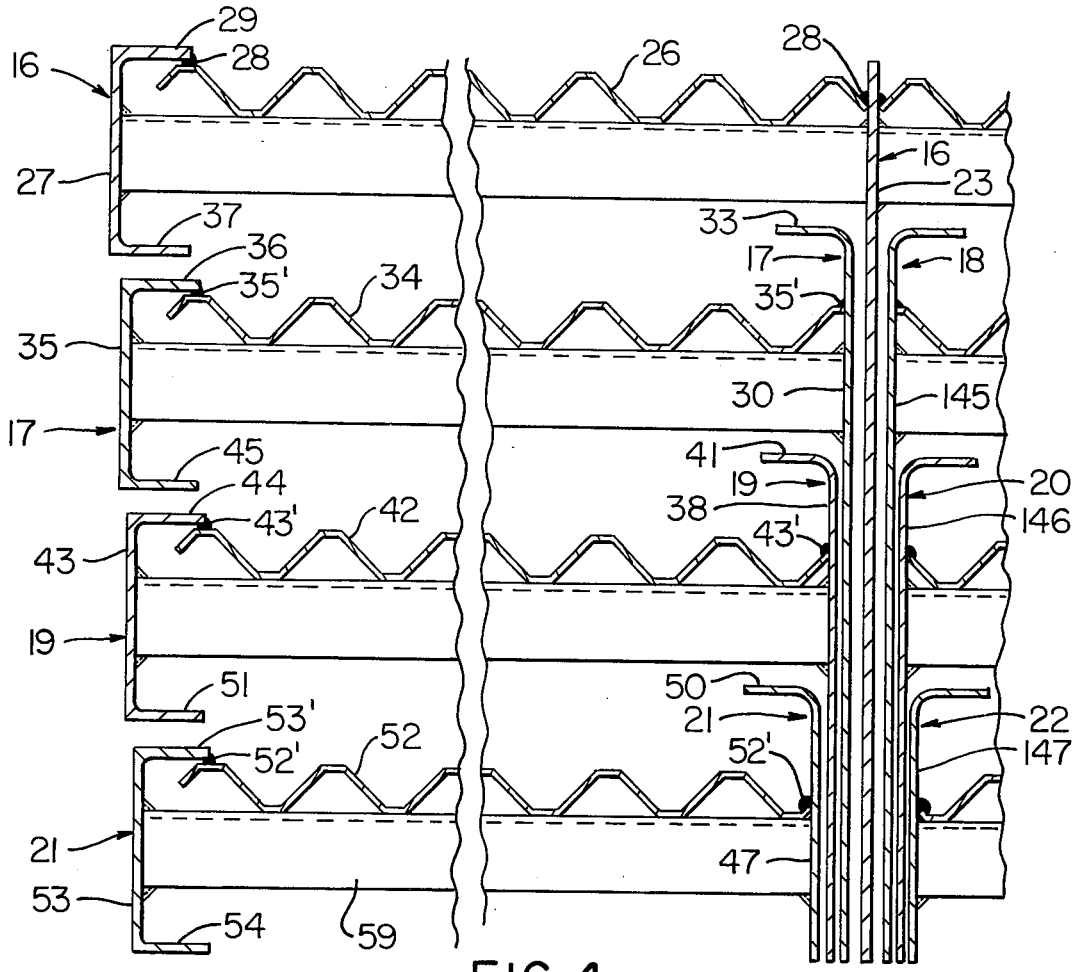
FIG. 4 is a fragmentary transverse sectional view of a portion of the cover of FIG. 3 and taken along line 4—4 of FIG. 3.

As shown in FIG. 4, the flange 33 of the end plate 30 is disposed in a substantially horizontal plane above lower leg 37 of each of the U-shaped channels 27 of the housing 16 so that the flange 33 will overlap the lowermost leg 37 of each of the U-shaped channels 27 when the cover 14 is in its closed position. This prevents rain from entering therebetween and enables the housing 17 to move the housing 16 if the housing 16 has to be moved in the same direction as that in which the housing 17 is moved when the housing 17 is moved to the closed position of the cover 14.

Figure 6:
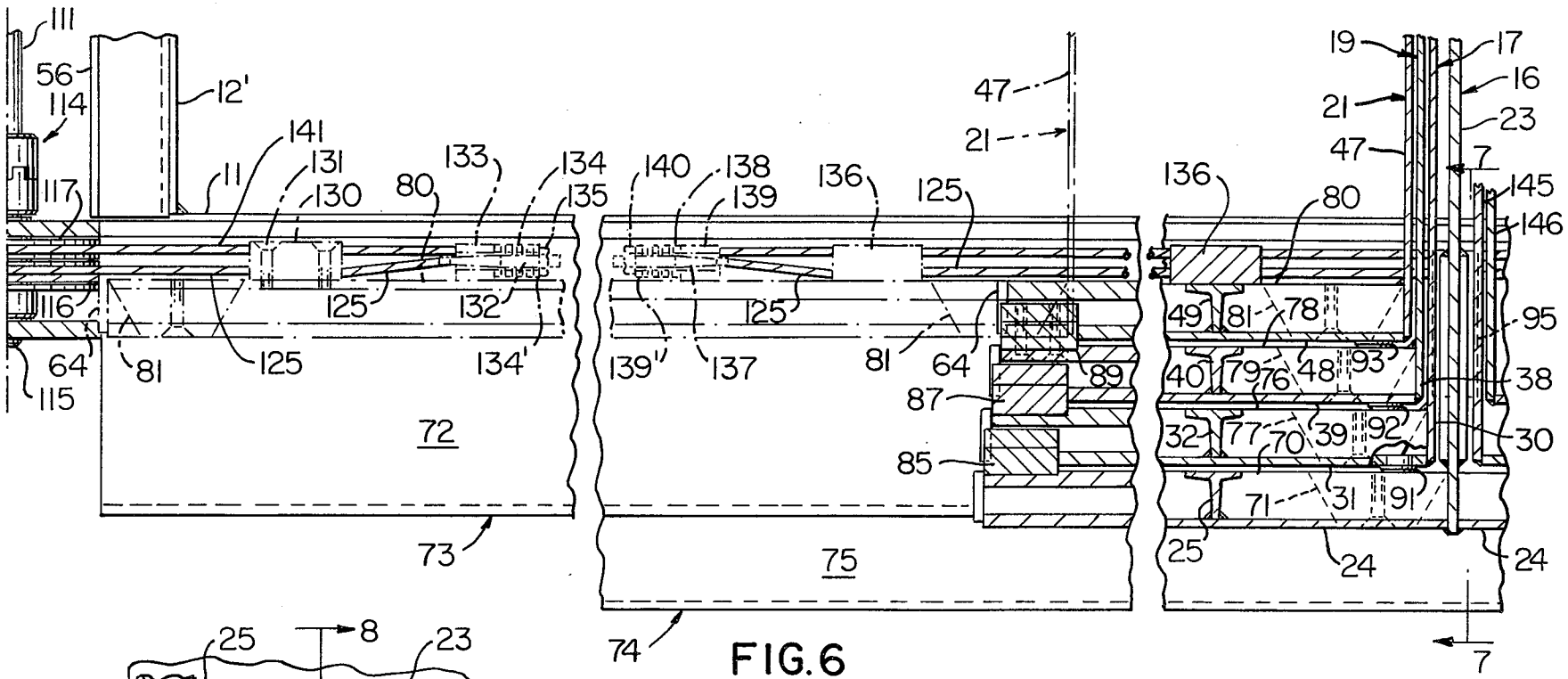
FIG. 6 is a fragmentary plan sectional view of a portion of the cover of FIG. 3 and taken along line 6—6 of FIG. 3.

The housing 19 has an end plate 38, which is substantially parallel to the end plate 30 of the housing 17 and adjacent thereto when the cover 14 is in an open position. The end plate 38 has a siding 39 of aluminum attached to each side thereof as shown in FIG. 6 by suitable means such as welding, for example. Each of the sidings 39, which are substantially parallel to each other and to the sidings 24 and 31, is stiffened by longitudinally spaced T-shaped stiffeners 40 of aluminum on its inner surface.

The end plate 38 has a flange 41 (see FIG. 4) at its upper end and extending for the entire distance of the end plate 38 in the transverse direction. Corrugated roofing sheets 42 of aluminum extend between the end plate 38 adjacent the flange 41 and each of a pair of U-shaped channels 43 of aluminum at the forward end of the housing 19. An adhesive sealant 43' or suitable mechanical fasteners secure each of the roofing sheets 42 to the end plate 38 and upper leg 44 of one of the channels 43.

The flange 41 of the end plate 38 is disposed in a substantially horizontal plane above lower leg 45 of each of the U-shaped channels 35 of the housing 17. Thus, when the cover 14 is in its closed position, the flange 41 of the end plate 38 overlies the lower legs 45 of the U-shaped channel 35 of the housing 17 to prevent any rain from entering therebetween. The end plate 38 and the U-shaped channels 35 engage during movement of the housing 19 when the cover 14 is being moved from an open position to its closed position to transmit the motion of the housing 19 to the housing 17.

The housing 21 has an end plate 47, which is substantially parallel to the end plate 38 of the housing 19 and adjacent thereto when the cover 14 is in an open position. The end plate 47 has a siding 48 (see FIG. 6) of aluminum attached to each side thereof by suitable means such as welding, for example. Each of the sidings 48, which are substantially parallel to each other and to the sidings 24, 31, and 39, has longitudinally spaced T-shaped aluminum stiffeners 49 on its inner surface to add stiffness thereto.

The upper end of the end plate 47 has a flange 50 (see FIG. 4) extending transversely for the same distance as the end plate 47. The flange 50 is disposed in a plane above lower leg 51 of each of the U-shaped channels 43 of the housing 19. Thus, when the cover 14 is in its closed position, the flange 50 overlies the lower leg 51 of each of the U-shaped channels 43 of the housing 19 to prevent rain from entering therebetween. Additionally, the overlying of the flange 50 over the lower leg 51 of each of the channels 43 insure that there is contact of the end plate 47 with the U-shaped channels 43 of the housing 19 when the housing 21 has been moved forwardly from the position of FIG. 4.

Corrugated roofing sheets 52 of aluminum extend between the end plate 47 adjacent the flange 50 and each of a pair of U-shaped channels 53 of aluminum at the forward end of the housing 21. An adhesive sealant 52' or suitable mechanical fasteners secure each of the roofing sheets 52 to the end plate 47 and upper leg 53' of one of the channels 53.

Figure 5:
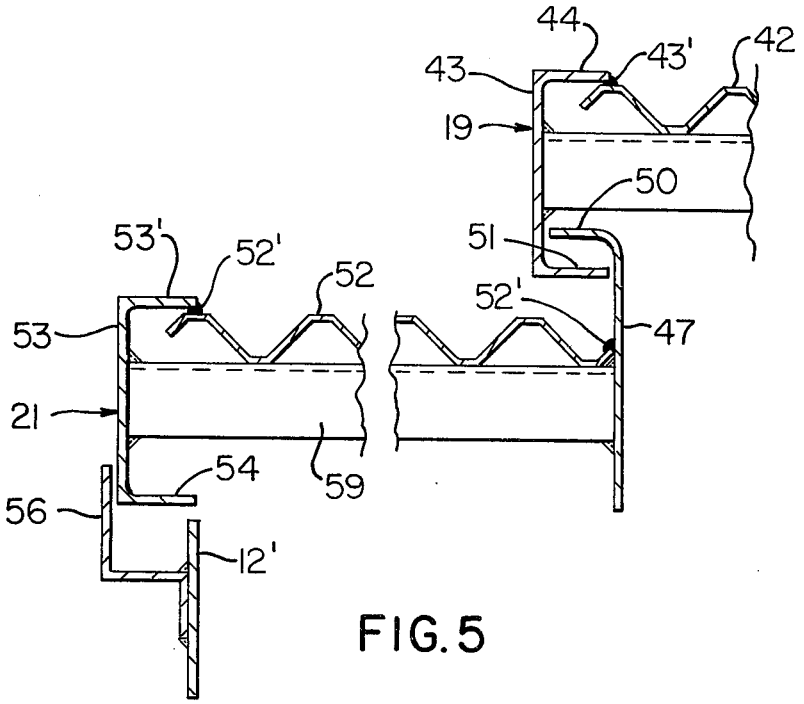
FIG. 5 is a fragmentary transverse sectional view of a portion of the cover of FIG. 3, similar to FIG. 4, but showing one of the two outermost housings of the cover in its closed position.

When the cover 14 is in its fully closed position, lower leg 54 of each of the U-shaped channels 53 of the housing 21 overlies the end wall 12' (see FIG. 5) of the barge 10. A Z-shaped bracket 56, which is supported on the outer surface of the end wall 12', cooperates with each of the U-shaped channels 53 to form the rain seal therebetween. Any rain collected between the Z-shaped bracket 56 and the end wall 12' may be drained from the Z-shaped bracket 56 by suitable holes (not shown) in the horizontal portion of the Z-shaped bracket 56.

Figure 3:
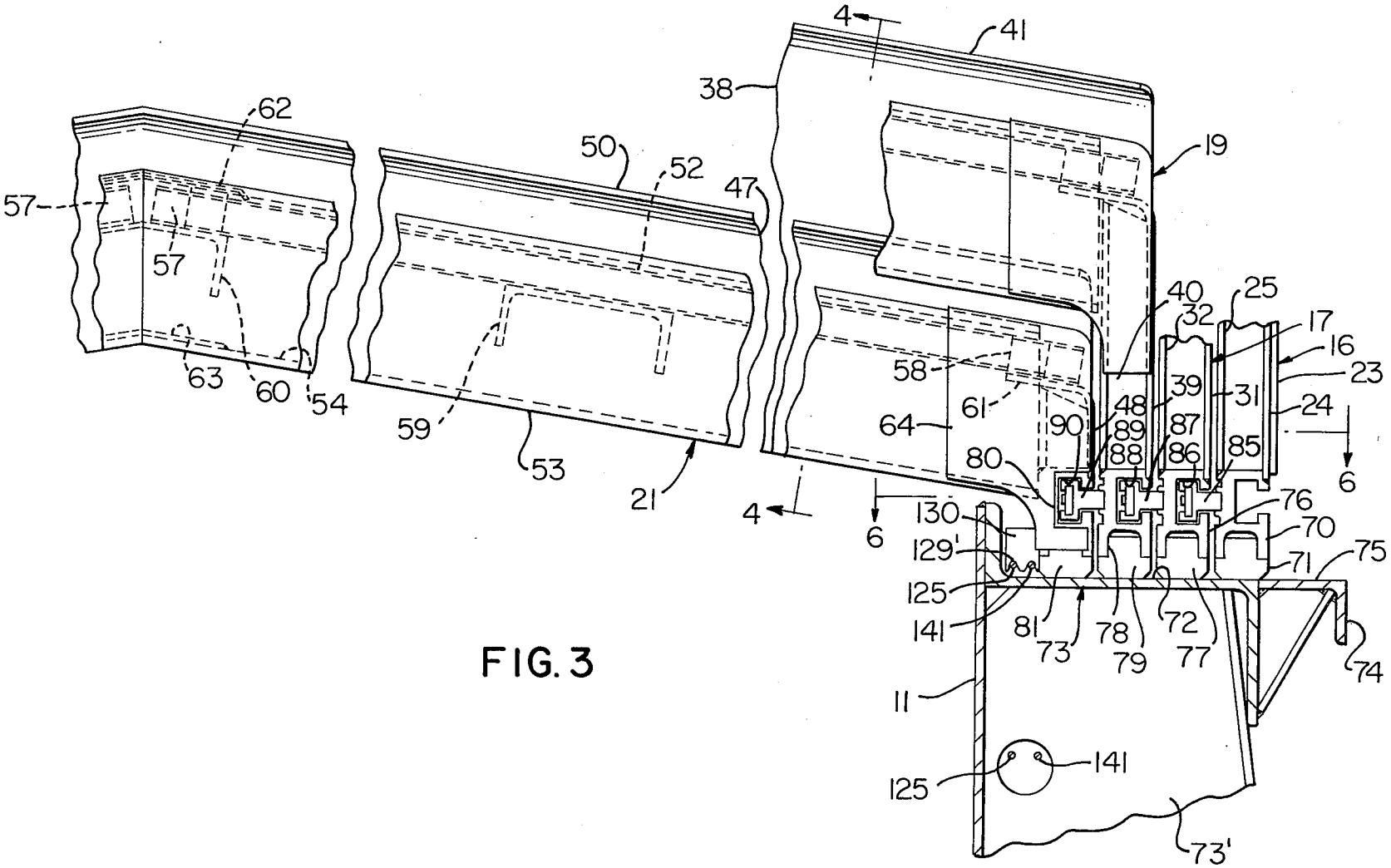
FIG. 3 is a fragmentary front elevational view of the cover when in its open position of FIG. 2 and taken substantially along line 3—3 of FIG. 2.

As shown in FIG. 3, one of the roofing sheets 52 of the housing 21 is closed at its inner and upper end adjacent the centerline of the cover 14 by a longitudinal bearing block 57 of aluminum and at its lower and outer end by a longitudinal bearing block 58 of aluminum. These prevent rain from entering the corrugated roofing sheet 52. A similar arrangement exists for the other roofing sheet 52.

Each of the roofing sheets 52 is supported intermediate its ends by a longitudinally extending U-shaped channel 59 of aluminum. The inner and upper end of each of the roofing sheets 52 is supported on a portion of a ridge channel 60 of aluminum. The lower and outer end of each of the roofing sheets 52 is supported on a flange 61 at the upper end of one of the sidings 48.

A longitudinally extending ridge cap 62 of aluminum overlies the pillow block 57 for each of the roofing sheets 52. The ridge cap 62 and the ridge channel 60 cooperate to secure the inner and upper ends of the two roofing sheets 52 to each other.

A longitudinally extending reinforcement plate 63 of aluminum overlaps the abutting lower leg 54 of each of the two U-shaped channels 53 of the housing 21. The plate 63 is secured to each of the two channels 53 to join them together. Each of the roofing sheets 26 (see FIGS. 1 and 4), 34, and 42 is similarly supported as each of the roofing sheets 52.

The lower and outer end of each of the U-shaped channels 53 of the housing 21 is secured to the adjacent of the sidings 48 by a gusset plate 64 of aluminum as shown in FIG. 3. A similar arrangement exists for each of the other of the housings 16 (see FIG. 6), 17, and 19.

An extruded rail 70 (see FIG. 3) of aluminum is secured to the lower end of each of the sidings 24 of the housing 16 and the lower end of each of the stiffeners 25 by suitable means such as welding, for example. Each of the rails 70, which extend for the length of each of the sidings 24, has a plurality of glides 71 secured to its lower end and longitudinally spaced from each other.

Each of the glides 71 on one of the rails 70 of the housing 16 has its lower surface engaging a flat surface 72, which functions as a track bed for the glides 71, of the horizontal portion of a Z-shaped bracket 73 of steel. The bracket 73 is secured to the outer surface of the side wall 11 of the barge 10 by suitable means such as welding, for example. The bracket 73 also is supported by longitudinally spaced coaming gusset brackets 73', which are supported by the barge 10 and formed of steel.

An L-shaped bracket 74 of steel is secured to the outer side of the Z-shaped bracket 73 by suitable means such as welding, for example. The bracket 74 provides an additional flat surface 75 for the central portion of the length of the flat surface 72.

The side wall 12 of the barge 10 has a similar track arrangement to that shown for the side wall 11. Thus, the glides 71 extending from the other of the rails 70 of the housing 16 ride on this flat surface.

Each of the sidings 31 of the housing 17 has an extruded rail 76 of aluminum extending downwardly therefrom and secured to the siding 31 and the stiffeners 32 in the same manner as the rails 70 are secured to the sidings 24 and the stiffeners 25 of the housing 16. Each of the rails 76, which extend for the length of each of the sidings 31, has a plurality of glides 77 secured thereto in longitudinally spaced relation and extending downwardly therefrom for riding along one of the flat surfaces (one shown at 72) in the same manner as the glides 71.

An extruded rail 78 of aluminum is secured to the lower end of each of the sidings 39 of the housing 19 and the lower ends of the stiffeners 40 in the same manner as the rails 70 are secured to the sidings 24 and the stiffeners 25. Each of the rails 78, which extend for the length of each of the sidings 39, has a plurality of glides 79 secured thereto in longitudinally spaced relation to each other for riding along the flat surface 72 in the same manner as the glides 71 and the glides 77 ride along one of the flat surfaces (one shown at 72).

Figure 8:
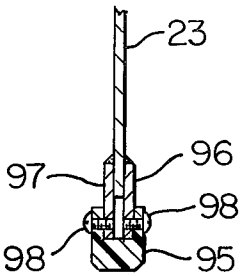
FIG. 8 is a fragmentary sectional view of a portion of the central housing and taken along line 8—8 of FIG. 7.

An extruded rail 80 is supported at the lower end of each of the sidings 48 of the housing 21 and the lower ends of the stiffeners 49 (see FIG. 6) in the same manner as the rails 70 (see FIG. 8) are supported at the lower ends of the sidings 24 and the stiffeners 25. Each of the rails 80, which extend for the length of each of the sidings 48, has glides 81 secured on its lower end in longitudinally spaced relation for riding along one of the flat surfaces (one shown at 72).

The guides 71, 77, 79, and 81 are formed of a material having an extremely low coefficient of friction, a very high abrasion resistance, and a high shock resistance. One suitable example of this material is an ultra high molecular weight polyethylene sold by Hercules as HIFAX 1900.

Each of the rails 70 of the housing 16 has a T-shaped guide 85, which is formed of the same material as the glides 71, 77, 79, and 81, secured thereto at its inner side adjacent its forward end as shown in FIG. 6. Each of the guides 85 has its head disposed within a recess 86 in the rail 76 of the housing 17 adjacent thereto as shown in FIG. 3. This prevents relative movement between the housings 16 and 17 in a sidewise direction even though there may be sidewise movement of the housing 16 due to the center of the barge 10 being deflected inwardly by its load as well as preengagement due to barge wall deflection.

Each of the rails 76 of the housing 17 has a T-shaped guide 87, which is formed of the same material as the glides 71, 77, 79, and 81, secured thereto at its inner side adjacent its forward end as shown in FIG. 6. Each of the guides 87 has its head disposed within a recess 88 in the adjacent rail 78 of the housing 19 as shown in FIG. 3. Thus, relative movement between the housings 17 and 19 in a sidewise direction is prevented.

Each of the rails 78 of the housing 19 has a T-shaped guide 89, which is formed of the same material as the glides 71, 77, 79, and 81, secured thereto at its inner side adjacent its forward end as shown in FIG. 6. Each of the T-shaped guides 89 has its head disposed in a recess 90 in the adjacent rail 80 of the housing 21 as shown in FIG. 3. This prevents relative movement between the housings 19 and 21 in the sidewise direction.

Each of the glides 71, 77, 79, and 81 has its forward and rear edges bevelled as shown in FIG. 6. Thus, when the housing 21 moves from an open position to its closed position, the forward beveled edge of each of the glides 81 is at an angle to push any material away from the path of the glide 81 and into the path of the glides 79. In a similar manner, the movement of the glides 79 of the housing 19 pushes any material on the flat surface 72 of the bracket 73 out of its path and into the path of the glides 77. Accordingly, any contaminated material is continuously moved to the outer side of the cover 14 by the glides 81, 79, 77, and 71. This prevents any contamination of the track, which is the flat surface 72. A similar arrangement exists when the housings 16, 17, 19, and 21 are moved toward the aft end of the barge 10.

Each of the sidings 31 of the housing 17 has a button 91 (see FIG. 6) supported adjacent the end plate 30. The two buttons 91 prevent metal to metal contact between the housings 16 and 17 adjacent the rear portion of the housing 17. Each of the buttons 91 has its outer surface engage the inner surface of each of the adjacent longitudinally spaced stiffeners 25 during the relative movement between the housings 16 and 17.

Each of the sidings 39 of the housing 19 has a button 92 supported adjacent the end plate 38. The outer surface of each of the buttons 92 engages the inner surface of each of the adjacent longitudinally spaced stiffeners 32 during relative movement between the housings 17 and 19 to prevent metal to metal contact therebetween.

Each of the sidings 48 of the housing 21 has a button 93 extending therefrom adjacent the end plate 47. The outer surface of each of the buttons 93 engages the inner surface of each of the adjacent longitudinally spaced stiffeners 40 during relative movement between the housings 19 and 21 to prevent metal to metal contact therebetween.

Each of the buttons 91, 92, and 93 is formed of the same material as the glides 71, 77, 79, and 81. Thus, this material has a relatively low coefficient of friction to enable contact of the button and the adjacent stiffeners without any sufficient drag being created on the movement of the housing having the button.

Each of the housings 18, 20, and 22 is formed in the same manner as the housings 17, 19, and 21, respectively. The housing 16 is formed similarly on the end receiving the housing 18 as has been described for the end of the housing 16 receiving the housing 17.

Figure 7:
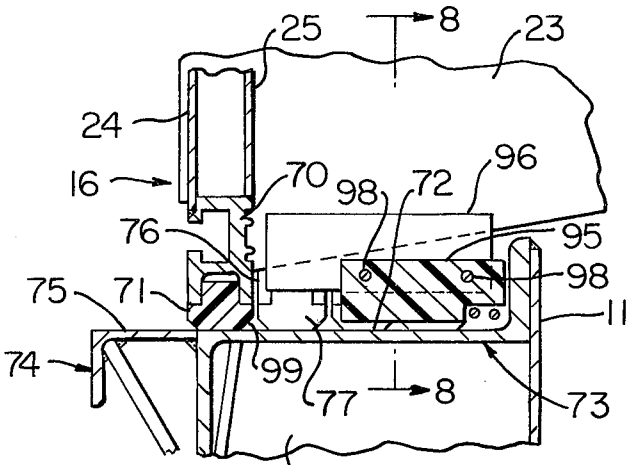
FIG. 7 is a sectional view, partly in elevation, of a portion of the cover of FIG. 6 and taken along line 7—7 of FIG. 6.

As shown in FIGS. 3 and 7, each of the glides 71 has its track engaging surface riding on the extreme outer portion of the flat surface (one shown at 72). Thus, if the barge 10 should deflect inwardly at the center of its length due to a dense load, for example, then at least some of the glides 71 will move onto the flat surface (one shown at 75) of the bracket (one shaft at 74).

However, the bracket 74 does not extend for the entire length of the bracket 73 but only in the central portion. Therefore, if any of the glides 71 should cease to be supported on the flat surface 75 of the bracket 74, for example, due to inward movement of the side walls 11 and 12 of the barge 10, the housing 16 will be supported by a center glide 95 (see FIG. 7), which is formed of the same material as the glides 71.

The center glide 95 is supported at the bottom end of each of a pair of aluminum brackets 96 and 97 (see FIGS. 6 and 8) by screws 98. The brackets 96 and 97 are fixed to the transverse plate 23 by suitable means such as welding, for example.

Accordingly, the center glide 95 engages the flat surface 72 of the bracket 73 if the bottom surface of some of the glides 71 cease to be supported on the flat surface 75 of the bracket 74 or the flat surface 72 of the bracket 73. Each of the glides 71 has a bevelled surface 99 to enable the glide 71 to ride back upon the flat surface 72 or 75 after having been displaced therefrom. It should be understood that the transverse plate 23 has another of the center glides for cooperation with the flat surface (not shown) of the Z-shaped bracket (not shown) supported on the side wall 12.

Figure 9:
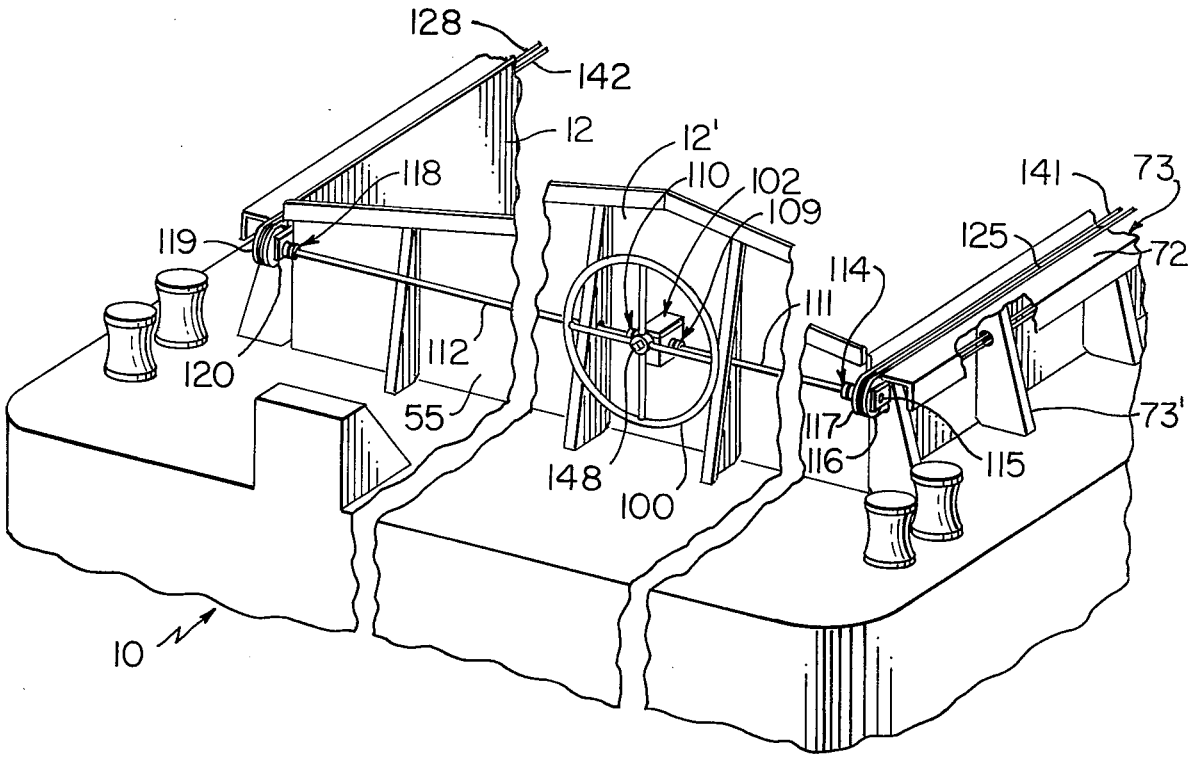
FIG. 9 is an enlarged fragmentary perspective view of a portion of the bow of the barge of FIG. 1 and showing a portion of the driving arrangement for moving some of the housings of the cover of the present invention.
Figure 10:
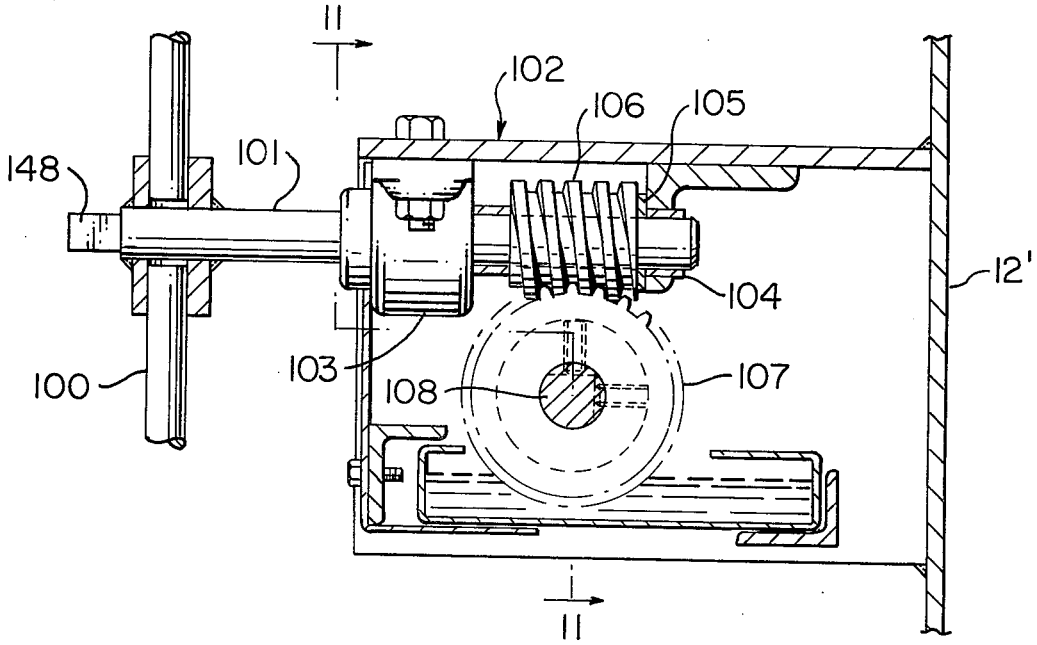
FIG. 10 is a cross sectional view of the gear box of the driving arrangement of FIG. 9.

Referring to FIGS. 9 and 10, there is shown a handwheel 100, which is secured to a shaft 101 extending from a gear box 102. The gear box 102 is mounted on the end wall 12' of the barge 10 as shown in FIG. 10.

The shaft 101 is supported in the gear box 102 by a pillow block 103 and bearings 104 and 105. A worm 106 is keyed to the shaft 101 for rotation therewith. The worm 106 meshes with a worm gear 107, which is secured to a shaft 108 extending in a direction transverse to the direction of the shaft 101.

Figure 11:
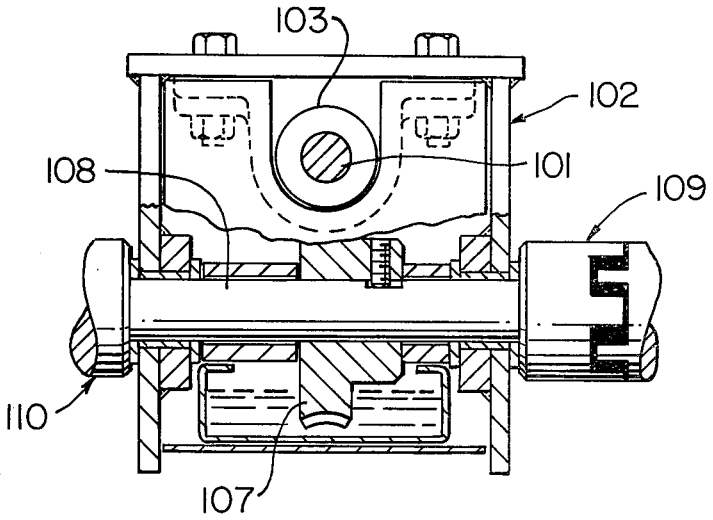
FIG. 11 is an elevational view, partly in section, of the gear box of FIG. 10 and taken along line 11—11 of FIG. 10.

The shaft 108 is supported for rotation within the gear box 102 by bearings as shown in FIG. 11. The shaft 108 has one end connected to a flexible coupling 109 and its other end connected to a flexible coupling 110.

The flexible coupling 109 couples the shaft 108 to a shaft 111 (see FIG. 9). The flexible coupling 110 couples the shaft 108 (see FIG. 11) to a shaft 112 (see FIG. 9).

Figure 13:
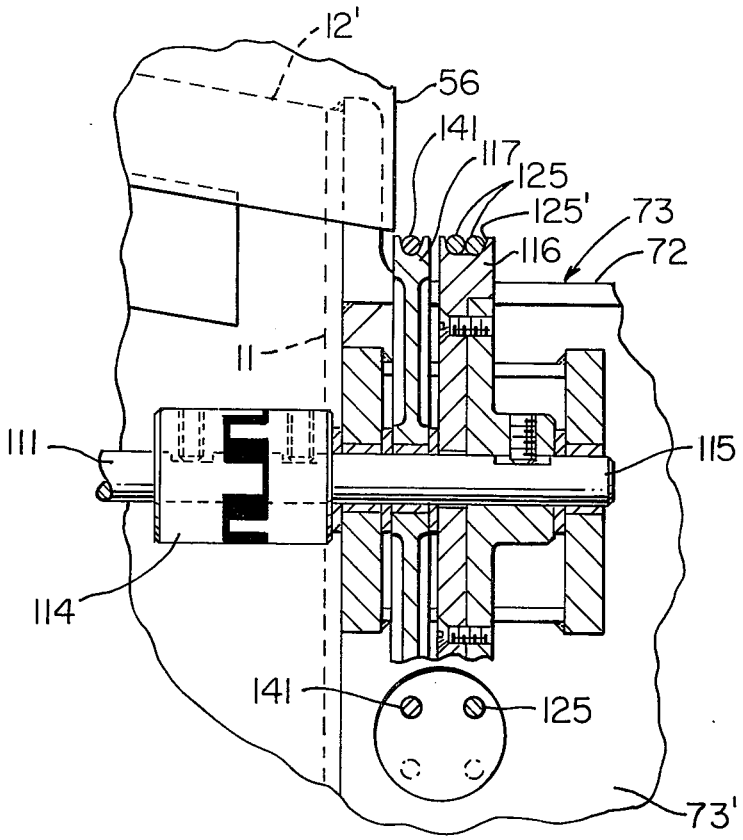
FIG. 13 is a fragmentary sectional view of the driving arrangement of FIG. 12 and taken along line 13—13 of FIG. 12.

The shaft 111 is connected through a flexible coupling 114 (see FIG. 13) to a shaft 115. The shaft 115 has a driven pulley 116 fixed thereto for rotation therewith and a pulley 117, which is inboard of the driven pulley 116, rotatably mounted thereon so that the pulley 117 is an idler pulley.

The shaft 112 (see FIG. 9) is connected through a flexible coupling 118 to a shaft (not shown) having a driven pulley 119 mounted thereon in the same manner as the driven pulley 116 is mounted on the shaft 115 and an idler pulley 120, which is inboard of the driven pulley 119, rotatably mounted on the shaft, which is connected through the flexible coupling 118 to the shaft 112, in the same manner as the pulley 117 is rotatably mounted on the shaft 115.

Accordingly, rotation of the handwheel 100 in one direction causes rotation of the driven pulleys 116 and 119 in one direction while rotation of the handwheel 100 in the opposite direction causes rotation of the driven pulleys 116 and 119 in the opposite direction. When there is no driving of the worm 106 (see FIG. 10) by the handwheel 100, the worm gear 107 is locked against movement by the worm 106 since the worm gear 107 cannot transmit movement to the worm 106. In other words, a worm gear has no reverse input power.

Figure 12:
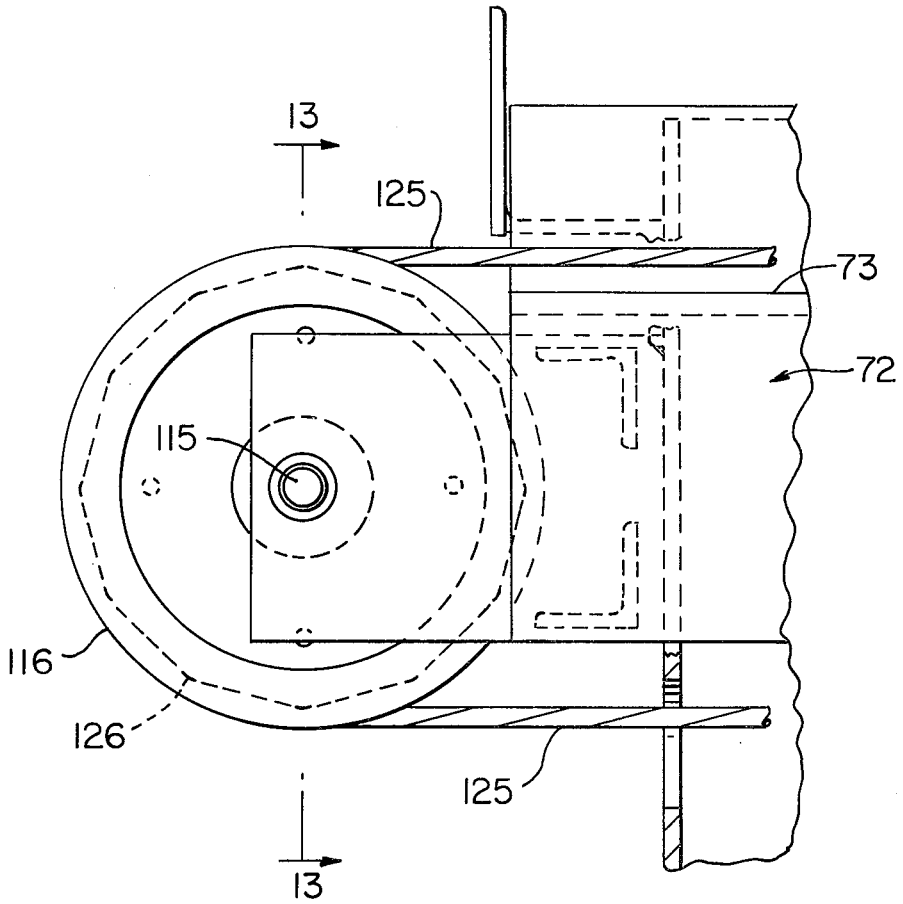
FIG. 12 is an enlarged fragmentary side elevational view of the end of the driving arrangement of FIG. 9.

The driven pulley 116 (see FIG. 13) has one and one-half revolutions of a cable 125 wrapped therearound in its groove 125'. As shown in FIG. 12, the pulley 116 is formed with a plurality of raised points (twelve shown) 126 in its groove 125' (see FIG. 13) to provide a more positive contact with the cable 125.

One end of the cable 125 (see FIG. 14) extends from the upper portion of the pulley 116 and is secured to the housing 21. The other end of the cable 125 extends from the bottom portion of the pulley 116 and passes around an idler pulley 127 at the aft end of the barge 10 (see FIG. 9). The pulley 127 (see FIG. 14) is rotatably mounted in a manner similar to that shown in FIG. 13 for the idler pulley 117, but the pulley 127 is positioned outboard of the driven pulley at the aft end in order that there is alignment between the pulley 116 and the idler pulley 127. After passing around the idler pulley 127, the end of the cable 125 is connected to the housing 21 at a spaced longitudinal distance from the connection of the upper end of the cable 125 to the housing 21.

The driven pulley 119 has a cable 128 passing therearound in the same manner as the cable 125 is wrapped around the pulley 116. One end of the cable 128 extends from the upper portion of the pulley 119 for securing to the housing 21 on the opposite side thereof from the securing of one end of the cable 125. The other end of the cable 128 extends from the lower portion of the pulley 119 and around an idler pulley 129 (see FIG. 14), which is at the aft end of the barge 10 (see FIG. 9) and mounted outboard of a driven pulley on the same shaft in a manner similar to the idler pulley 127 (see FIG. 14) being mounted outboard of the driven pulley. After passing around the idler pulley 129, the other end of the cable 128 is secured to the housing 21 on the opposite side thereof from the connection of the other end of the cable 125. Accordingly, the housing 21 moves longitudinally along the barge 10 (see FIG. 9) in response to the rotation of the handwheel 100.

After leaving the lower portion of the pulley 116, the cable 125 passes through a groove 129' (see FIG. 3) in the lower surface of a centering block 130 (see FIGS. 3 and 6), which is secured to the rail 80 of the housing 21 adjacent the lower end of the rail 80 by screws 131 (see FIG. 6). After passing through the centering block 130, the cable 125 is swedged to a threaded rod 132, which is at an inclined angle to the horizontal.

The rod 132 extends through a mounting block 133, which is secured to the upper end of the rail 80 by suitable means such as welding, for example, at an inclined angle to the horizontal so that its passage for the rod 132 is at an angle to the horizontal whereby the rod 132 is at the same angle to the horizontal. A spring 134 is disposed between the mounting block 133 and a washer 134' with a nut 135, which is threaded on the end of the threaded rod 132, bearing against the washer 134'. The spring 134 is compressed between the mounting block 133 and the washer 134' by tightening the nut 135.

Figure 14:
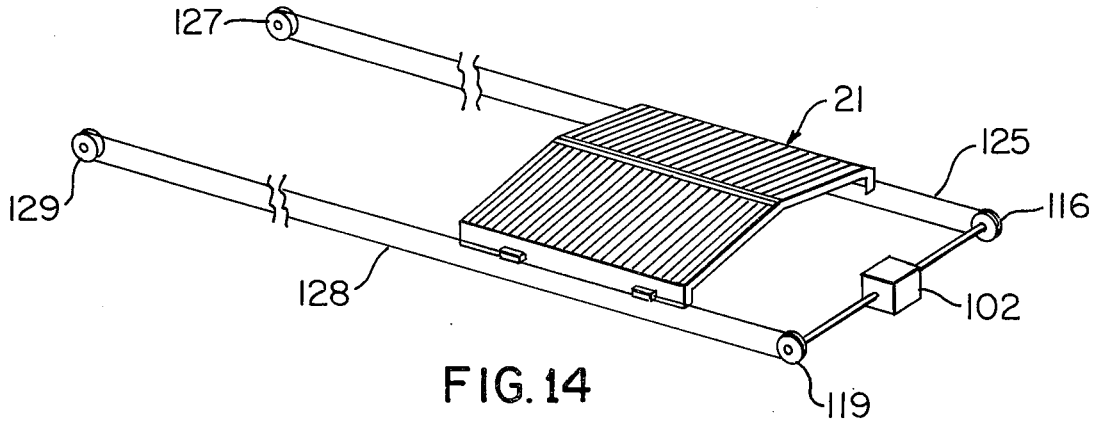
FIG. 14 is a schematic view of the driving arrangement of FIG. 9.

The other end of the cable 125 passes through a groove (not shown) in the lower surface of a centering block 136, which is secured to the rail 80 in the same manner as the centering block 130, after having passed around the idler pulley 127 (see FIG. 14). After passing through the centering block 136 (see FIG. 6), the other end of the cable 125 is swedged to a threaded rod 137, which is at the same inclined angle to the horizontal as the rod 132 but inclined in the opposite direction, in the same manner as the one end of the cable 125 is swedged to the threaded rod 132. To absorb tension and shock during collision or overturning of the handwheel 100 (see FIG. 9) a spring 138 (see FIG. 6) is disposed between a mounting block 139, which is secured by suitable means such as welding, for example, to the upper end of the rail 80 at the same angle to the horizontal as the mounting block 133 but inclined in the opposite direction, and a washer 139' with a nut 140 on the threaded rod 137 bearing against the washer 139'. Thus, through turning the nuts 135 and 140, the cable 125 has the desired tension placed thereon.

The cable 128 (see FIG. 14) is similarly connected to the other side of the housing 21. Thus, the cable 128 has the desired tension placed on its ends.

The housing 22 (see FIG. 1) is driven by a handwheel (not shown) at the aft end of the barge 10 and having a similar arrangement for driving a cable 141 (see FIG. 13), which passes around the driven pulley on the shaft rotatably supporting the idler pulley 127 (see FIG. 14) and around the idler pulley 117 (see FIG. 9). A cable 142 is disposed on the opposite side of the barge 10 from the cable 141 and extends around the idler pulley 120 and around the driven pulley on the shaft rotatably supporting the idler pulley 129 (see FIG. 14).

Therefore, turning of the handwheel at the aft end of the barge 10 (see FIG. 9) causes the cables 141 and 142 to move the housing 22 (see FIG. 1) in either longitudinal direction along the barge 10 depending on the direction of rotation of the handwheel. Thus, each of the housings 21 and 22 can be separately moved at the same time when such is needed; this would require two persons. Both of the housings 21 and 22 must be moved when the cover 14 has the housings 16–22 in the telescoped relation at either end in an open position.

If the cover 14 is in its open position in the center of the barge 10, then it is only necessary to turn one of the two handwheels (one shown at 100) to move the cover 14 to either end. However, if it is desired to move the cover 14 to its closed position from the center position, then each of the housings 21 and 22 must be moved, but it is not necessary that they be moved simultaneously as is required when the cover 14 is in an open position at either end of the barge 10.

When the cover 14 is in its closed position and it is desired to move the cover 14 to the open position of FIG. 2, for example, then the housing 21 would be moved into the housing 19. This telescoping movement of the housing 21 into the housing 19 eventually results in the end plate 47 (see FIG. 4) of the housing 21 engaging the end plate 38 of the housing 19 whereby the housing 19 is then moved with the housing 21. Continued movement of the housings 19 and 21 results in the end plate 30 of the housing 17 eventually being engaged by the end plate 38 of the housing 19 whereby the housing 17 moves with the housings 19 and 21.

When the housings 17, 19, and 21 have been completely telescoped within the housing 16, then the end plate 30 of the housing 17 engages the transverse plate 23 of the housing 16. This then causes the housing 16 to move so that the transverse plate 23 engages an end plate 145 of the housing 18. Further continued movement of the housings 17, 19, 21, 16, and 18 eventually causes the end plate 145 of the housing 18 to engage an end plate 146 of the housing 20. This causes movement of the housing 20 with the housings 18, 16, 17, 19, and 21 until the end plate 146 of the housing 20 engages an end plate 147 of the housing 22. When this occurs, no further movement of the housings 21, 19, 17, 16, 18, and 20 of the cover 14 can occur because the housing 20 has its U-shaped channels (not shown) engage a Z-shaped bracket (not shown) on the aft end wall (not shown) of the hopper area 13 (see FIG. 2) of the barge 10 in the same manner as the U-shaped channels 53 (see FIG. 5) of the housing 21 engage the Z-shaped bracket 56 on the forward end wall 12'.

From this position of the cover 14 (see FIG. 1), both the handwheel 100 and the handwheel (not shown) at the aft end of the barge 10 would have to be rotated at the same time. The rotation of the handwheel 100 in the opposite direction to that in which it had previously been rotated to dispose the cover 14 in the open position of FIG. 2 would cause the housing 21 to move toward the forward end wall 12' of the hopper area 13 of the barge 10. The rotation of the handwheel at the aft end of the barge 10 would cause the housings 22 (see FIG. 1), 20, 18, 16, 17, and 19 to follow this movement of the housing 21 because of the engagement of the various end plates.

This movement of the housings 16–22 by turning both of the handwheels (one shown at 100) would cause each of the housings 17–22 to remain in the telescoped relation of FIGS. 2 and 4. Then, when the transverse plate 23 of the housing 16 reaches the center of the barge 10, the continued movement of the handwheel 100 (see FIG. 9) in the same direction would cause the housing 21 (see FIG. 4) to be pulled out from its telescoped relation with the housing 19. When the end plate 47 of the housing 21 engages the lower leg 51 of each of the U-shaped channels 43 of the housing 19, the housing 19 follows the movement of the housing 21 so as to be pulled out from the housing 17.

When the end plate 38 of the housing 19 engages the lower leg 45 of each of the U-shaped channels 35 of the housing 17, the housing 17 follows the movement of the housings 19 and 21 so as to be pulled out from the housing 16. This continues until the housing 21 can no longer be moved through the housing 21 having reached the closed position of FIG. 5 in which the U-shaped channels 53 engage the Z-shaped bracket 56.

At the same time that the housings 21, (see FIG. 1), 19, and 17 are being removed from the telescoped relation with the housing 16, the handwheel at the aft end of the barge 10 must be rotated in the opposite direction to cause similar movement of the housings 22, 20, and 18. This results in the housings 22, 20, and 18 being sequentially pulled out of the telescoped relation with the housing 16.

If the housings 16–22 were not moved in this manner from the open position of the cover of FIG. 2, the handwheel 100 would have to be turned to eventually pull not only the housing 21 (see FIG. 1), 19, and 17 from the telescoped relation with the housing 16 but would also have to move the housings 16, 18, and 20. This would require a substantial force by the person operating the handwheel 100. Therefore, the previously described manner of moving the housings 16–22 of the cover 14 from the open position of FIG. 2 to the closed position of FIG. 1 is preferred.

Instead of using the handwheels (one shown at 100) to move the housings 16–22 of the cover 14, a portable electric motor, for example, could be employed. To enable the connection of the portable power source such as an electric motor to the shaft 101 (see FIG. 10) for connection to the square shaped receptacle on the end of the output shaft of the portable electric motor, the shaft 101 has a square-shaped end 148 (see FIGS. 9 and 10). Thus, the portable electric motor can be connected to the shaft 101 without having to move the handwheel 100. The shaft having the handwheel at the aft end of the barge 10 is similarly formed.

Figure 15:
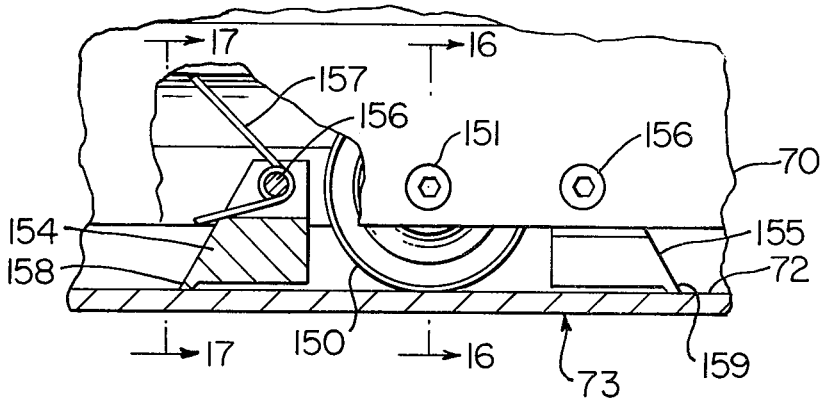
FIG. 15 is a fragmentary elevational view, partly in section, of a modification of the present invention in which each of the housings of the cover is supported on wheels rather than glides.
Figure 16:
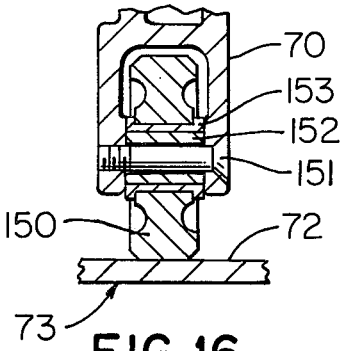
FIG. 16 is a fragmentary sectional view showing the mounting of the wheel of FIG. 15 and taken along line 16—16 of FIG. 15.
Figure 17:
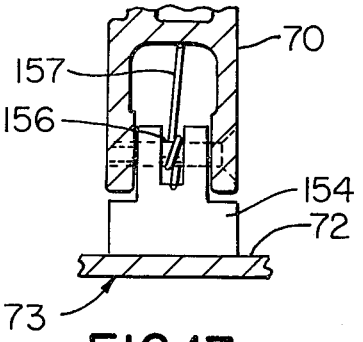
FIG. 17 is a fragmentary sectional view showing the mounting of a scraper block of FIG. 15 and taken along line 17—17 of FIG. 15.

Referring to FIGS. 15–17, there is shown an arrangement in which each of the glides 71, 77, 79, and 81 is replaced by a wheel 150. As shown in FIG. 16, the wheel 150 is rotatably supported at the lower end of the rail 70 of the housing 16, for example, by being rotatably mounted on a screw 151, which extends through the sides of the rail 70. A spacer sleeve 152 surrounds the sleeve 151 and has a sleeve bearing 153 riding thereon and on which the inner surface of the wheel 150 is supported so that the wheel 150 is rotatably mounted.

Scraper blocks 154 (see FIG. 15) and 155 are disposed on opposite sides of the wheel 150 in the path of movement of the wheel 150 along the flat surface 72, for example. Each of the scraper blocks 154 and 155, which are in longitudinal alignment with the wheel 150, is supported on the rail 70, for example, by a screw 156 (see FIG. 17). A spring 157 acts on each of the scraper blocks 154 and 155 to cause a protruding bottom surface 158 (see FIG. 15) and 159, respectively, to engage the flat surface 72, for example, of the bracket 73. This insures that any material on the flat surface 72, for example, is removed from the path of the wheel 150 during movement of the housing 16 in either longitudinal direction.

An advantage of this invention is that the barge cover is relatively lightweight in comparison with prior metallic barge covers. Another advantage of this invention is that no additional structure is required for locking the cover in any position to which it is moved. A further advantage of this invention is that the cover requires only a relatively short period of time to be moved between its open and closed positions and with a relatively small number of personnel. Still another advantage of this invention is that a positive driving arrangement is provided to the cables for moving the housings of the cover, thereby preventing misalignment between port and starboard component parts or cover sides.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. A cover for a hopper area of a barge including a central housing having a transverse plate extending across the center of said central housing, at least one housing disposed on each end of said central housing and being telescopically received within said central housing at any position of said central housing, said housings covering the hopper area when said housings are in their extended positions, said transverse plate limiting the movement of said telescoping housings within said central housing while enabling each of said telescoping housings to be telescopically received within said central housing, each of said housings having support means to support said housings on the barge for movement therealong; and said transverse plate transmitting movement of said housing on one side of said transverse plate to said central housing when said housing on the one side of said transverse plate moves toward said transverse plate to be telescopically received within said central housing and into engagement with said transverse plate and transmitting movement of said housing on the other side of said transverse plate to said central housing when said housing on the other side of said transverse plate moves toward said transverse plate to be telescopically received within said central housing and into engagement with said transverse plate.

2. The cover according to claim 1 including a first plurality of housings disposed at one end of said central housing and telescopically received within said central housing, a second plurality of housings disposed at the other end of said central housing and telescopically received within said central housing, and the outermost of each of said plurality of housings being telescopically received within the next innermost housing of each of said plurality of housings.

3. The cover according to claim 2 including first means to sequentially move each of said housings of said first plurality of housings and second means, separate from said first means, to sequentially move each of said housings of said second plurality of housings.

4. The cover according to claim 3 in which said first means includes first drive means connected to the outermost housing of said first plurality of housings and first cooperating means on each adjacent pair of housings of said first plurality of housings to cause movement of the outermost housing of said first plurality of housings to be transmitted to the adjacent housings of said first plurality of housings in sequence and said second means includes second drive means connected to the outermost housing of said second plurality of housings and second cooperating means on each adjacent pair of housings of said second plurality of housings to cause movement of the outermost housing of said second plurality of housings to be transmitted to the adjacent housings of said second plurality of housings in sequence.

5. The cover according to claim 4 in which said support means includes a plurality of surface engaging means on each side of each of said housings engaging a flat surface supported on each side of the barge and each of said housings having said surface engaging means on the same side thereof aligned with each other in the direction of movement.

6. The cover according to claim 5 in which said surface engaging means on each side of each of said housings comprises a plurality of longitudinally spaced glides, each of said glides has a flat surface to engage one of the flat surfaces supported on the barge, and each of said housings has said glides on the same side thereof aligned with each other in the direction of movement.

7. The cover according to claim 5 including cooperating guide means on each adjacent pair of said housings to limit movement of the adjacent pair of housings in the transverse direction.

8. The cover according to claim 5 in which said surface engaging means on each side of each of said housings comprises a plurality of longitudinally spaced wheels riding on one of the flat surfaces supported on the barge, each of said housings has said wheels on the same side thereof aligned with each other in the direction of movement, and means spaced longitudinally from each of said wheels in each longitudinal direction to remove any debris from the path of said wheel during movement of said wheel in a longitudinal direction along one of the flat surfaces supported on the barge.

9. The cover according to claim 4 in which said first drive means includes a pair of driven pulleys disposed on opposite sides of the barge, a cable passed around each of said driven pulleys, each of said driven pulleys has a plurality of raised points to engage said cable wrapped therearound, and means to connect the two ends of each of said cables to two spaced longitudinal portions of said outermost housing of said first plurality of housings; and said second drive means includes a pair of driven pulleys disposed on opposite sides of the barge, a cable passed around each of said driven pulleys, each of said driven pulleys has a plurality of raised points to engage said cable wrapped therearound, and means to connect the two ends of each of said cables to two spaced longitudinal portions of said outermost housing of said second plurality of housings.

10. The cover according to claim 9 in which each of said driven pulleys has a groove to receive said cable and said groove has said raised points around its circumference to form the only contacting surface of said groove of said pulley with said cable.

11. The cover according to claim 4 in which said first drive means includes means to lock the outermost housing of said first plurality of housings against movement and said second drive means includes means to lock the outermost housing of said second plurality of housings against movement.

12. The cover according to claim 1 in which said support means includes a plurality of surface engaging means on each side of each of said housings engaging a flat surface supported on each side of the barge, and each of said housings having said surface engaging means on the same side thereof aligned with each other in the direction of movement.

13. The cover according to claim 12 in which said surface engaging means on each side of each of said housings comprises a plurality of longitudinally spaced glides, each of said glides has a flat surface to engage one of the flat surfaces supported on the barge, and each of said housings has said glides on the same side thereof aligned with each other in the direction of movement.

14. The cover according to claim 12 in which said surface engaging means on each side of each of said housings comprises a plurality of longitudinally spaced wheels riding on one of the flat surfaces supported on the barge, each of said housings has said wheels on the same side thereof aligned with each other in the direction of movement, and means spaced longitudinally from each of said wheels in each longitudinal direction to remove any debris from the path of said wheel during movement of said wheel in a longitudinal direction along one of the flat surfaces supported on the barge.

15. The cover according to claim 12 including cooperating guide means on each adjacent pair of said housings to limit movement of the adjacent pair of housings in the transverse direction.

16. The cover according to claim 1 including cooperating guide means on each adjacent pair of said housings to limit movement of the adjacent pair of housings in the transverse direction.

17. The cover according to claim 15 including each of said housings having support means on each side thereof to support said surface engaging means on the same side and said support means also supporting said cooperating guide means on the same side of the same housing.

18. The cover according to claim 12 including cooperating guide means on each adjacent pair of said housings to prevent relative movement between the adjacent pair of housings in the transverse direction.

19. The cover according to claim 5 including cooperating guide means on each adjacent pair of said housings to prevent movement between the adjacent pair of housings in the transverse direction.

20. The cover according to claim 1 including cooperating guide means on each adjacent pair of said housings to prevent relative movement between the adjacent pair of housings in the transverse direction.

21. The cover according to claim 9 in which said first drive means includes means to lock the outermost housing of said first plurality of housings against movement and said second drive means includes means to lock the outermost housing of said second plurality of housings against movement.

22. The cover according to claim 21 in which said locking means of said first drive means includes gear means and said locking means of said second drive means includes gear means.

23. The cover according to claim 11 in which said locking means of said first drive means includes gear means and said locking means of said second drive means includes gear means.

* * * * *